US006067834A

United States Patent [19]

Stone

[11] Patent Number: 6,067,834

[45] Date of Patent: May 30, 2000

[54] METHOD FOR STAMPING BOWED PIECE-PARTS

[75] Inventor: Kenneth W. Stone, Streamwood, Ill.

[73] Assignee: Buhrke Industries, Inc., Arlington Hts., Ill.

[21] Appl. No.: 09/371,982

[22] Filed: Aug. 11, 1999

Related U.S. Application Data

[62] Division of application No. 09/071,769, May 1, 1998, Pat. No. 5,946,961.

[51] Int. Cl.[7] ..... B21D 28/06; B21D 5/14; B21D 5/08

[52] U.S. Cl. ..... 72/130; 72/161; 72/177; 72/334; 72/379.2; 72/337

[58] Field of Search ..... 72/130, 161, 177, 72/333, 334, 337, 338, 366.2, 365.2, 379.2

[56] References Cited

U.S. PATENT DOCUMENTS

| | | | |
|---|---|---|---|
| 3,262,299 | 7/1966 | Hart | 72/130 |
| 3,344,640 | 10/1967 | Zelnick | 72/168 |
| 3,516,137 | 6/1970 | Fisher | 72/334 |
| 4,320,647 | 3/1982 | Kummeling | 72/334 |
| 5,237,845 | 8/1993 | Kikuchi | 72/177 |

FOREIGN PATENT DOCUMENTS

| | | | |
|---|---|---|---|
| 262873 | 2/1929 | Italy | 72/177 |
| 40103 | 2/1989 | Japan | 72/177 |

*Primary Examiner*—Daniel C. Crane
*Attorney, Agent, or Firm*—Charles F. Lind

[57] ABSTRACT

A method of forming finished piece-parts having a slight but variably adjusted three-dimensional bow from a continuous web. The method comprises the steps of advancing the web axially of its length by bowing the web in the same direction of desired bowing in the piece-part, laterally and/or axially of the web length, operable to impart set bows in the web slightly in excess of the desired finished piece-parts bowing, passing the bowed continuous web through a conventional stamping press, clamping and substantially flattening the bowed web between flat faces of cooperating die block and stripper plate components of the stamping press and stamping the clamped web between cooperating punch and die assemblies to deform the web to the desired configurations of the finished piece-parts.

8 Claims, 7 Drawing Sheets

METHOD FOR STAMPING BOWED PIECE-PARTS

RELATED APPLICATION

This is a Divisional Application of application Ser. No. 09/071,769 filed on May 1, 1998, and originally entitled WEB BOWING APPARATUS AND METHOD FOR STAMPING BOWED PIECE-PARTS, with Kenneth W. Stone identified as the inventor, and now U.S. Pat. No. 5,946,961 issued on Sep. 7, 1999, and entitled WEB BOWING APPARATUS.

BACKGROUND OF THE INVENTION

Generally flat thin cross-section piece-parts of steel or rigid laminates of steel and another metal or rigid plastic material frequently might be fabricated by being stamped from a blank of material between matched tool components of a stamping press. A conventional stamping press will have separate sequential punch stations each with a pair of matched punch and die tool components, and the blank of material will be advanced through the stations where sequential strikes against it might be made by moving the tool components toward and away from one another, along axes generally normal to the blank material therebetween. This stamping procedure allows the use of matched tool components that can be economically made, and that will experience long service lives and be capable of reshaping under standard techniques and with conventional tolerances.

Efforts are also taken to make sure that the blank material is flat or planar in the stamping press, so that the piece-part will be flat and planar after being stamped. This can be more fully appreciated in the instance when the blank material is in the form of a continuous web unwound as needed from a coiled reel, whereby the web blank even when unwound might actually have slight three-dimensional curvatures (or biases to curve). In such instances, straightening or leveling equipment might be used to reshape the web to be flat and planar upon entering the press, in an effort to eliminate a curvature or bias in the stamped piece-part.

However, stamping specifications might call for the finished piece-part to have a slight three-dimensional bow. Prior to this invention, efforts to stamp slightly bowed piece-parts directly from a flat blank in a single or sequential stamping procedure by reshaping the matched tool components proved significantly more complicated. In fact, many problems surfaced, including the increased costs of making and maintaining the tool components with the bowed configurations, the dramatically experienced wear on such components with more frequent reshaping needed to maintain proper specifications, and the fact that the severe material removal of the tool components during reshaping significantly shortened the available service live, compared to conventional tool components. Further, different matched sets of tool components might be needed to make similar piece-parts, each specific to a desired degree of curvature or bow.

Efforts to bend or bow stamped flat piece-parts to some desired degree of curvature likewise have left much to be improved on, as individual handling of the piece-parts has proven to be labor intensive and costly. Moreover, direct press or straightening equipment contact on the opposite surfaces of the piece-parts might typically cause surface marring and/or leave noticeable crease lines thereon.

SUMMARY OF THE INVENTION

This invention relates to and an object of this invention is to provide improved method and apparatus for stamping finished piece-parts having slight but variably adjusted three-dimensional bowing, from a continuous material web in a conventional stamping press and with conventional tool components.

A related object of this invention is to provide improved apparatus for bowing a continuous web material being indexed in the direction axially along the length of the web, with curvatures about axes parallel to the web length (side-to-side or laterally of the web), and/or transverse to the web length (fore-and-aft or axially of the web), including structures for adjusting the degrees of the bowed curvatures.

Another related object of this invention is to provide an improved method for stamping finished three-dimensional bowed piece-parts from a continuous material web, by first bowing the material web locally to impose therein curvatures slightly more than but corresponding generally to the intended bowed piece-part, and then passing the bowed web through the stamping press and stamping the bowed web between conventional tooling components, and thereby flexing the bowed web substantially flat during the actual hit between the tool components but allowing the stamped piece-part to recover when leaving the stamping press and yet have the desired three-dimensional bow.

By way of example, this invention might effectively be applied to stamp slightly bowed piece-parts from a dimensionally stable material blank of a thickness or cross-section less than approximately 0.25".

BRIEF DESCRIPTION OF THE DRAWINGS

These and other objects, features or advantages of the invention will be more fully understood and appreciated after reviewing the following specification which includes as a part thereof the accompanying drawings, wherein.

While the drawings illustrate the approximate arrangement of the structural components, they are not to an exact scale or proportional scale and might be exaggerated to better illustrate the operation of the invention.

DETAILED DESCRIPTION OF A PREFERRED EMBODIMENT OF THE INVENTION

Figure 1:
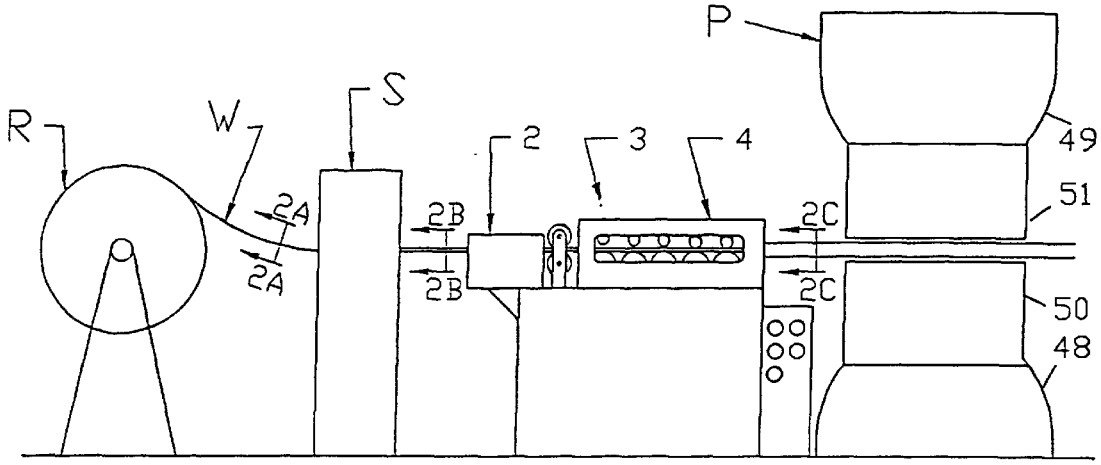
FIG. 1 is a side elevational view of a stamping set-up involving a material web, conventional straightening apparatus, the bowing apparatus of the subject invention, and stamping press.
Figure 2A:
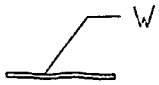
FIGS. 2*a*, 2*b* and 2*c* are sectional views of the material web as seen respectively from lines 2*a*—2*a*, 2*b*—2*b*, and 2*c*—2*c* in FIG. 1.
Figure 2B:
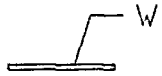

A side view of a stamping press layout utilizing the invention is illustrated in FIG. 1. Thus, a reel "R" can store a continuous material web "W" that is unwound in the direction along the length of the web, to pass through inventive bowing apparatus "B" and into stamping press "P". However, after being unwound, the web "W" might typically have arbitrary curvatures or biases along both the length and width of the web (see FIG. 2*a* showing curvatures across its width), so that it has been preferred to use conventional apparatus "S" to straighten the unwound web so that it might lie flat (see FIG. 2*b*) before entering the press "P". It might also be preferred to use the straightening apparatus "S" and have the unwound web flat before it might be passed through the inventive bowing apparatus "B".

Figure 2C:
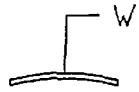

The bowing apparatus "B" includes different mechanisms 2 and 4 spaced apart relative to the axial length of the web and its travel through the apparatus. The mechanisms 2, 4 are respectively suited to provide adjustable curvatures about axes parallel to the opposite faces of the web) and respectively parallel to, or transverse to, the web length and the direction of web travel through the bowing apparatus. Specifically, mechanism 2 serves to deform the web and provide it with adjustable curvatures axially of web travel (or about the axis transverse to the web length), and mechanism 4 serves to deform the web and provide it with adjustable curvatures laterally of web travel (or about the axis parallel to the web length, see FIG. 2*c*).

The bowing mechanism 2 operates with two sets 5, 6 of paired or opposed upper and lower drive rollers 5*u*, 5*l* and 6*u*, 6*l*, spaced apart to provide spaced clearance gaps through which the web can pass, and a roller 8 located approximately axially midway between the end drive rollers. The middle roller 8 is mounted to be adjusted to move perpendicular to a plane extended generally through the gaps between the adjacent paired upper and lower rollers of the end sets 5, 6. The rollers can be cylindrical and of similar diameters; and the roller sets 5, 6 are spaced axially apart distances many times the roller diameters, so that the middle roller 8 can be moved to pass between the end roller sets 5, 6 to be either completely above or below the gap plane, with yet ample axial clearances existing between the rollers.

Figure 3A:
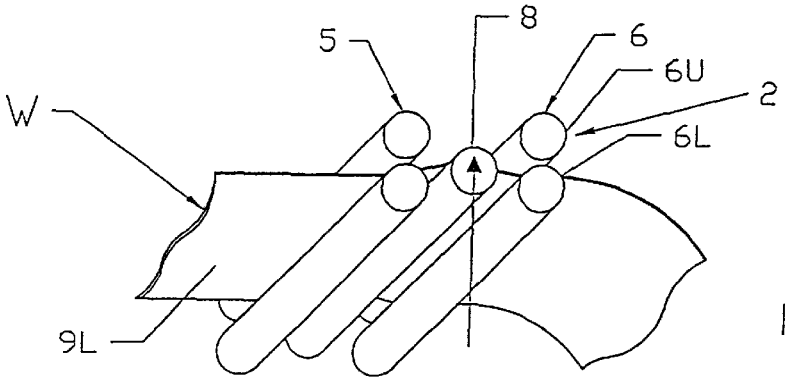
FIGS. 3*a* and 3*b* are perspective views of operating components of mechanism for bowing the web axially of its length or travel.
Figure 3B:
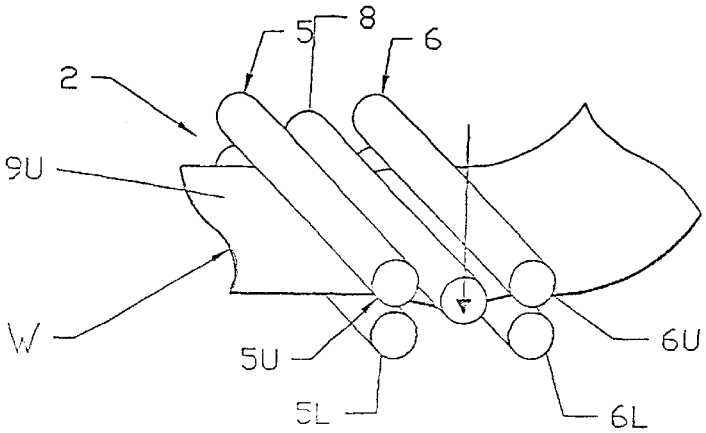

After the web is initially passed through the gaps between the end roller sets 5, 6, one mode of operation will have the middle roller 8 positioned next to the lower web face 91 (FIG. 3*a*) while the other mode of operation will have the middle roller 8 positioned next to the upper web face 9*u*. Roller adjustment in the direction toward the web will initially cause the roller 8 to engage and rotate on the adjacent web face, and if such adjustment is continued pass into or even completely through the gap plane. As so positioned, the roller 8 engages one face of the web and forces the opposite web face against end rollers 5*u*, 6*u* (FIG. 3*a*) and against the adjacent lower rollers 5*l*, 6*l* (FIG. 3*b*). The web when axially moving through the bowing mechanism 2 will follow the deformed curvatures illustrated between the end drive roller sets 5, 6 and around the mid roller 8, curving in a concave manner downwardly or upwardly, to above or below the gap plane extended through the gaps between the drive roller sets 5, 6. To curve the web concave downwardly (FIG. 3*a*), the middle roller 8 is biased against the lower web face 91 and is raised above the gap plane between the roller sets 5, 6; while to curve the web concave upwardly (FIG. 3*b*), the middle roller 8 is biased against the upper web face 9*u* and is lowered below the gap plane between the roller sets 5, 6.

Depending on the decree of forced curvature of the advancing web "W" traversing the axially separated rollers 5, 6, 8, the elastic limit of the web material can be exceeded to impose a residual set or bow in the web, tending to curve the web in the same direction as the forced flexure of the advancing web in passing through the axially spaced rollers 6, 7, 8. The opposed upper and lower drive rollers of each set 5, 6 are rotated under power in opposite directions to assist the axial advance of the web lengthwise through the apparatus while the advancing web is being flexed around the rollers 5, 6, 8.

Figure 4:
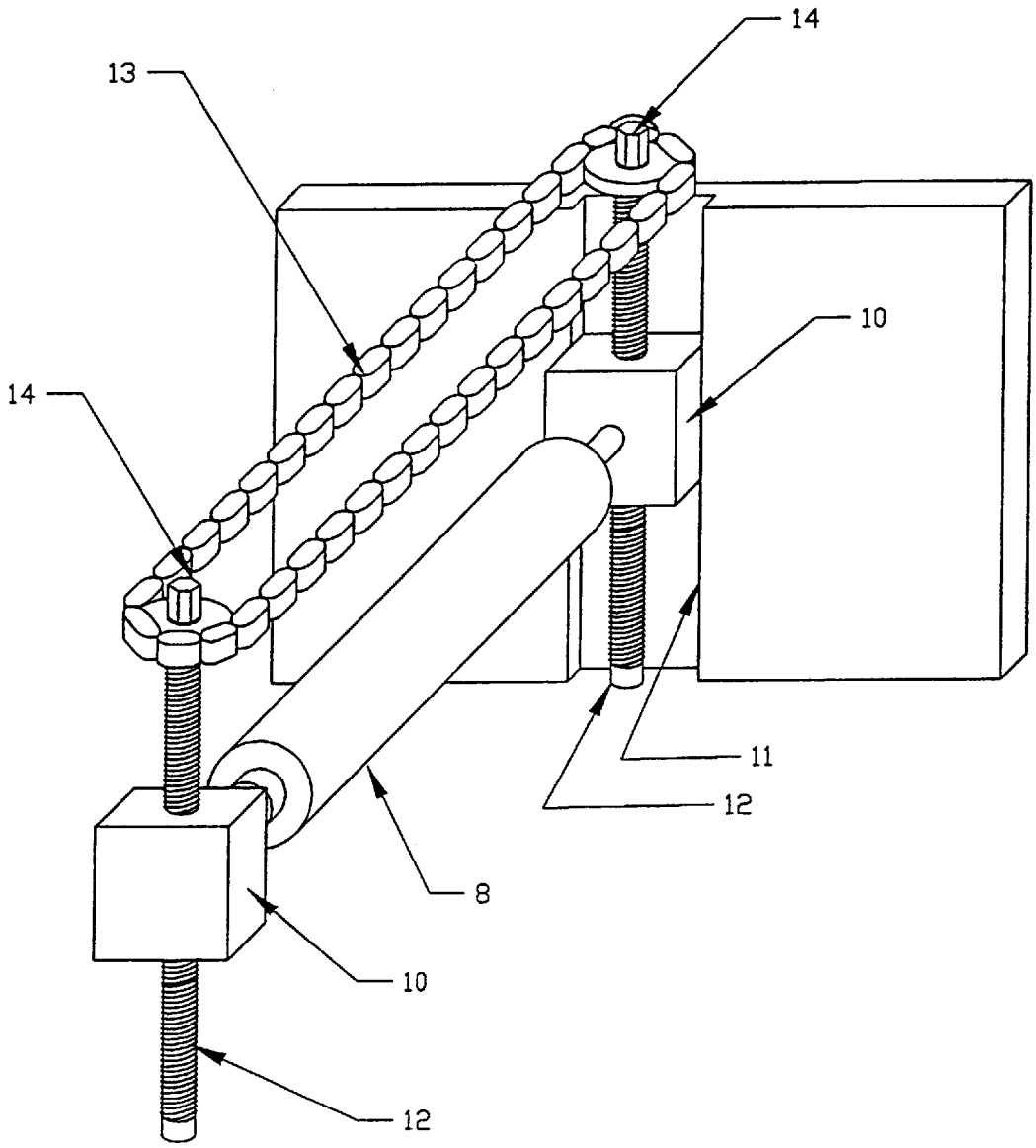
FIGS. 4 and 5 are additional perspective views of the axial bowing mechanism of FIGS. 3*a* and 3*b;*
Figure 8:
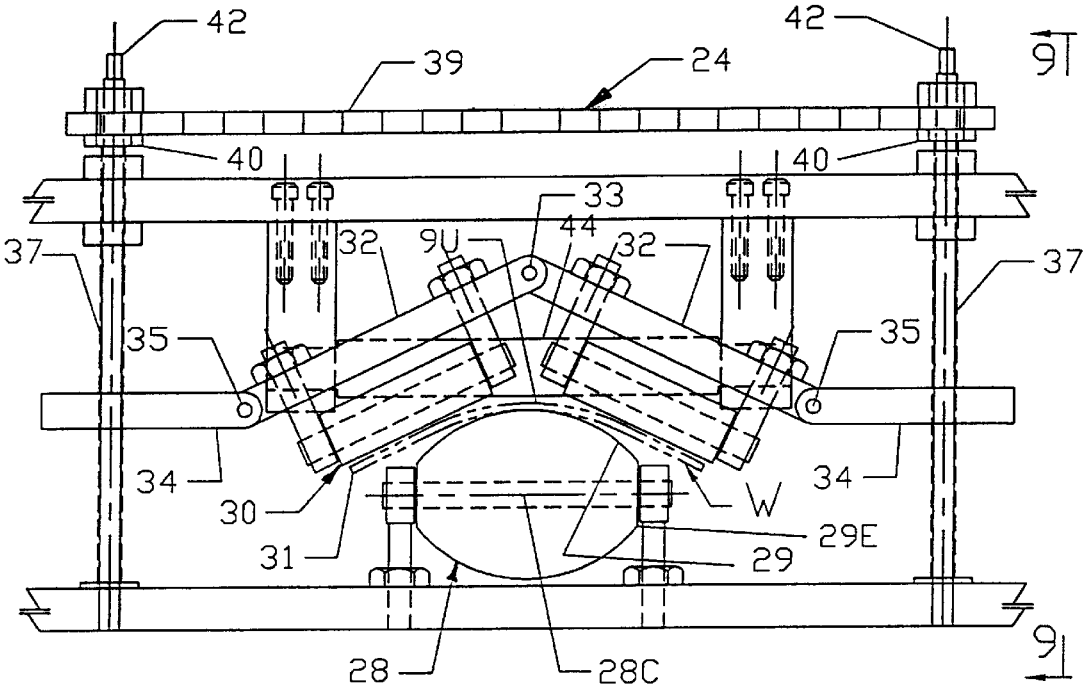
FIG. 8 is an elevational view of the lateral bowing mechanism as seen from line 8—8 in FIG. 7.
Figure 9:
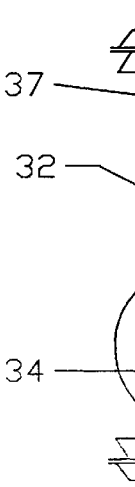
FIG. 9 is an elevational view of the lateral bowing mechanism as seen from line 9—9 in FIG. 8.
Figure 5:
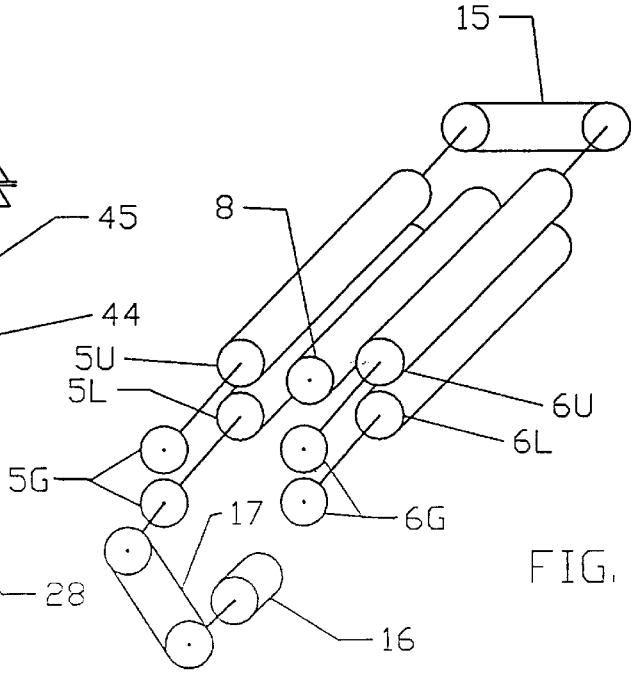
Figure 6:
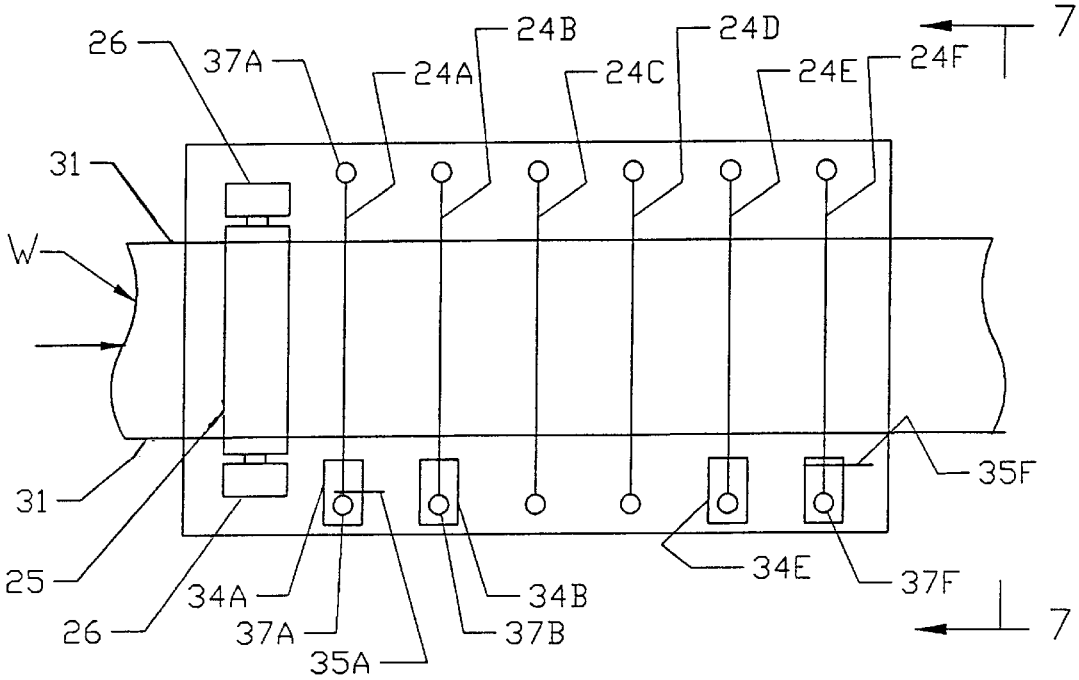
FIG. 6 is a top plan view, partly in schematic, of components of mechanism for bowing the web laterally of its length or travel.
Figure 7:
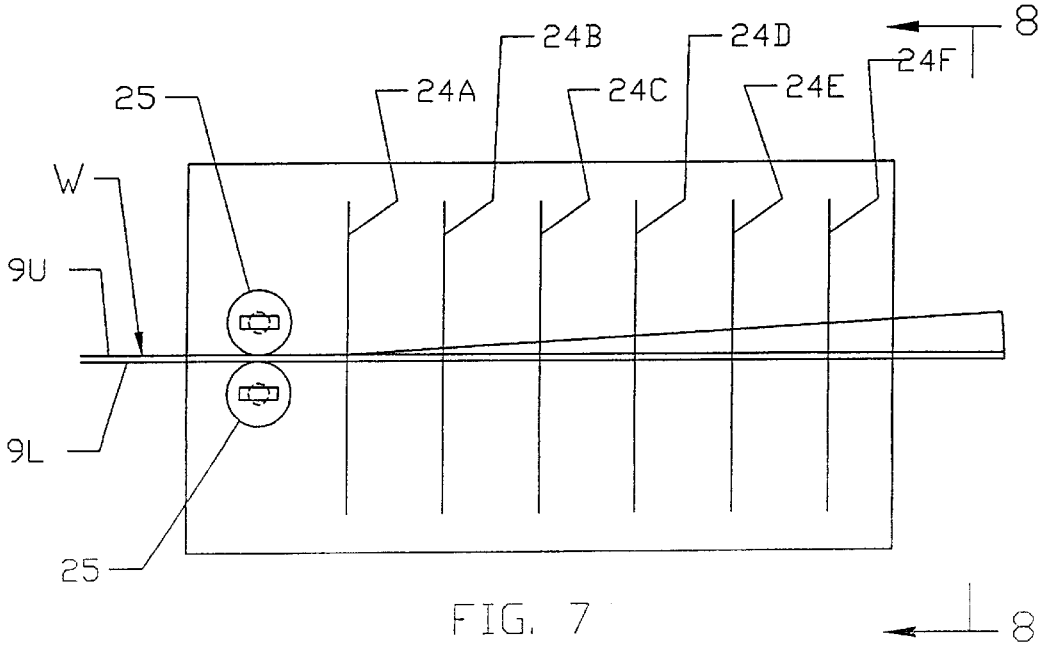
FIG. 7 is an elevational view of the lateral bowing mechanism as seen from line 7—7 in FIG. 6.

The bowing mechanism 2, as illustrated in greater detail in FIGS. 4 and 5. The middle roller 8 might be rotatably mounted at its ends in slide blocks 10 guided to move in frame channels 11. Helically threaded adjustment screws 12 are rotatably mounted and axially constrained by conventional bearing structures (not shown) and are in alignment parallel to the guide channels; and the slide blocks 10 are threaded onto the respective adjustment screws 12. A chain drive 13 including sprockets keyed to the respective screws, and a chain trained around the sprockets provide for the simultaneous rotation of the screws; and means such as a hex configuration 14 formed on the exposed upper screw ends can allow for manual screw rotation and mid roller adjustment by using only a conventional socket wrench or like tool. This allows for the accurate and yet convenient adjustment of the middle roller 8 transverse to the passing web, to create such web flexure needed to produce a desired residual set or bow. The opposed upper and lower drive rollers 5*u*, 5*l* and 6*u*, 6*l* are driven in unison in opposite directions by engaging gears 5*a*, 6*g* keyed to the respective roller shafts; and the end drive roller sets 5, 6 are powered in unison by chain drive 15 between the roller sets. A motor 16 via chain drive 17 to one of the roller sets can power all of the drive rollers simultaneously, for assisting the axial web advance in passing through the bowing mechanism 2.

Of further interest, with the cylindrical rollers 5, 6, 8 mounted to rotate on parallel axes, the imposed axial web bow or set can be substantially uniform across the web width at any specific axial location along the web. Moreover, while an axial set might be present in the web, it might not be visible as the web is leaving the bowing mechanism 2 because the web is yet continuous and other web driving forces will be acting axially on the web that may tend to overcome the set and otherwise hold the web substantially flat. Thus, the axial web bowing bias might only be seen and appreciated after the piece-part itself has been stamped from the web.

The bowing mechanism 4 includes opposed guide/drive rollers 25 arranged to engage the opposite upper and lower web faces 9*u* and 9*l*. The rollers 25 can be rotated in opposite directions by an appropriate chain drive and engaging gears (neither being shown) from motor 16, to keep the advancing web "W" as discharged from bowing mechanism 2 for passing then through the bowing mechanism 4. Bearing blocks 26 can rotatably support shaft ends of each drive roller 25 and these blocks can be guided in frame channels (not shown) to move the rollers toward and away from one another to accommodate webs of different thicknesses; and springs (not shown) can bias the blocks against the web under a resilient force.

The bowing mechanism 4 includes a plurality of forming stations (24 generally and 24*a*, 24*b*, 24*c*, etc. specifically), spaced apart in the axial direction of web travel. Each forming station 24 will have opposed shaping components 28, 30 adjacent the opposite faces of the web, specifically noting roller 28 adjacent the concave or inside lower web face 9*l* and a pair of rollers 30 (only one being shown for clarity of disclosure) on the convex or outside upper web face 9*u*, the inside and outside terms being referenced relative to the curvature of the bowed web.

The inside roller 28 is mounted to rotate about its longitudinal center axis 28*c*, which axis would be extended normal to the axial direction of web travel and parallel to the web faces (as they should be generally flat and parallel). The inside roller 28 has a peripheral surface 29 that is curved convex, somewhat as an American football, except having its opposite ends 29*e* cut off to be parallel to one another and perpendicular to the center axis. The peripheral surface 29 at the center of the roller 28 will thus define an annular band extended parallel to the center axis 28*c* and to the flat web faces; while the peripheral surface 29 spaced from the center of the roller 28 will curve progressively to its sharpest angles at the transition with the end surfaces. By way of example, the curvature can be about a uniform radius (such as eight inches) and a tangent line from the peripheral surface 29 at each opposite end surface transition, and extended through the center axis 28*c*, might be angled at possibly 10–45 degrees from the center axis. The inside roller 28 would be centered laterally relative to the web "W" passing over it, and in the illustrated embodiment, the web side edges 31 might lie laterally beyond and outwardly of the shaping roller end surfaces 29*e*, suited to have the middle portion only of the web bowed and to a lesser angle.

The outside shaping rollers 30 are supported by bridge members 32 connected together at adjacent end pivots 33 and connected to end blocks 34 at remote end pivots 35, whereby the bridge members thereby span over the upper web face 9*u*. The rollers 30 are essentially cylindrical in shape, being mounted on the underside of the bridge members 32 to rotate about center axes respectively parallel to the bridge members. Each end block 34 cooperates via a threaded bore therein with a height adjustment screw 37 journalled adjacent its ends relative to the frame and extended generally normal to the web "W" before entering the bowing apparatus 4. The two screws 37*a*, 37*b*, etc. of each forming station 24*a*, 24*b*, etc. are keyed together to be rotated simultaneously and by equal amounts, as by a chain drive including chain 39 trained over sprockets 40 keyed to the respective screws. Means such as hex head 42 on each screw 37 allow the use of a cooperating socket, wrench or manual tool to conveniently rotate the screws 37 of each forming station 24, for independently raising and/or lowering the heights at each station of the bridge members 32 and rollers 30 relative to the underlying web.

The two end blocks 34*a*, 34*b*, etc. of each forming station 24*a*, 24*b*, etc. can be of the same size, but the blocks for each successive forming stations will have a greater distance between the bores for the screw 37 and for the end pivot 35, to present the pivots 35 at each successive forming station closer together. This provides that with similar length bridge members 32, the upward inclines of the bridge members and rollers of each successive forming stations will be steeper than its immediately preceding adjacent forming station. However, so long as the steepness of the outside roller 32 does not exceed the slope of the inside roller face 29, the peripheral surface of each roller 32 will overlie and be parallel to different underlying circular portion of the shaping roller 28, for bowing the web. With these differently formed end blocks 34, the forming stations 24 can otherwise be comprised of identical components for economy and inventory management of fabrication, while the adjustment mechanism yet provides for adjustable and slight progressive lateral shaping of the web "W" as such is moved from one forming station (24*a* for example) to the next adjacent forming station (24*b*).

Each forming station 24 further might have a stabilizing roller 44 mounted on frame members 45 to rotate about its center axis that is extended normal to the flat web "W" and to the direction of web travel, for engaging the downstream sides of the bridge members for precluding axial deflection thereof.

In use, the web "W" is advanced substantially continuously through the bowing mechanism 4 under the power of drive rollers 25, and as such will pass sequentially through the forming stations 24*a*, 24*b*, etc. Depending on the degree of bow to be set in the web, the angle of incline of the sequential forming stations 24*a*, 24*b*, 24*c*, etc. will be adjusted to have the respective outside rollers 30 engage and ride along the upper web face 9*u* and force the lower web face 9*l* against the underlying peripheral face 29 on the inside forming roller 28. The stabilizing roller 44 will prevent axial deflection of the bridge members 32 and upper forming rollers 30 that might be caused by the generated axial forces of the web being moved between and through the rollers 28, 30.

It will be understood that once reshaped beyond the material strain level in the inventive bowing machine "B", the web "W" will retain at least some (although a lesser amount) of such deflection to have a bowed set when exited from the bowing mechanism 4. Of importance to the invention is the appreciation that a conventional stamping press will have specific cooperating punch and die components that will modify the advancing web with sequential strikes to form the piece-part "P", but that otherwise the cooperating punch and die components generally might not subject the web to any permanently deforming forces. This means that the bowed web "W" can be advanced through the press and even though its bowed configuration might be flattened somewhat or even totally, the resiliency of the web material will not be exceeded to eliminate all of the initial bow. Thus, a bowed piece-part can be formed in a standard press, while using conventional punch and die tool components.

To illustrate this, a conventional stamping press "P" with its standard components will be generally disclosed, being illustrated in FIGS. 1, 11, 12 and 13. For example, the press might have a stationary base 48 and an overlying ram 49 powered to move toward and away from the base, and conventional die and punch assemblies 50, 51 can respectively be supported on the base and carried on the ram, with cooperating pin-bushing means 53 providing for consistent and accurate reciprocating stamping strikes. The punch assembly 51 can include adjacent punch pad or holder 54, with punches 55 held thereby. A stripper plate 56 is guided by headed bolts 57 trapped in shouldered bores 59 in the die holder 54, so that it can be moved along the bolts relative to the die holder. The stripper plate has clamping face 60 overlying the web "W" or blank to be stamped, and the die assembly 50 can include die blocks 62 defining clamping face 63 underlying the web or blank to be stamped. The adjacent faces 60, 63 of the stripper plate, die blocks define, when separated, a pathway between which the web "W" can be advanced (guided laterally by spaced guide pins or the like), and the advancing web commonly will be elevated slightly above the die blocks face by spring biased lifters 66 engaging the side web edges. The stripper plate has openings 68 and the die blocks 61 have openings 69 to-receive the punches 55.

One operational position of the stripper plate 56 might have the punches 55 retracted or essentially withdrawn from exposure behind the stripper plate face 60, and the other operational position might have the punches protruding beyond the stripper plate face, typically by a distance exceeding the thickness of the web or material blank operable to punch completely therethrough. The stripper plate 56 is biased by springs 70 to the retracted position, so that when it is moved against the indexed web "W", its face 60 will engage the web and flex it substantially flat under the spring forces against the die blocks face 63, before the punches 55 shift relative to the stripper plate 56 and/or engage the web. The clamping faces 60, 63 effectively hold the indexed web therebetween, but with only a limited compression caused by the springs 70. Continued movement of the press ram 49 and punches 55 toward the die blocks 61 drives the punches through the stripper plate openings 68 for a punch hit against the blank. Bottoming blocks 72 provided between the adjacent punch and die assemblies 60, 61 can be adjusted to limit the heights of the closed punch-die assemblies, to prevent excessive punch penetration into die block opening or the like which could damage the die. The reverse upward movement of the press ram 49 separates the punches 55 from the die assembly 50, and punches then protruding through the blank will be stripped from the blank by the stripper plate face 60 being spring biased there against; and the headed bolts 57 will then carry the stripper plate 56 with the withdrawing ram, but slightly separated below the punch holder 54 in the die retracted position. Any blank portions severed during the stamping procedure, including both scrap and the stamped piece-parts "P", can pass to an underlying collection bin or take-away conveyor for later recovery.

Depending on the configuration and cooperation of the punch/die assemblies, the stamping strike can serve for shaping ribs, bosses, etc. on the blank surfaces, and/or for cutting, shearing or for piercing through the blank.

Figure 10:
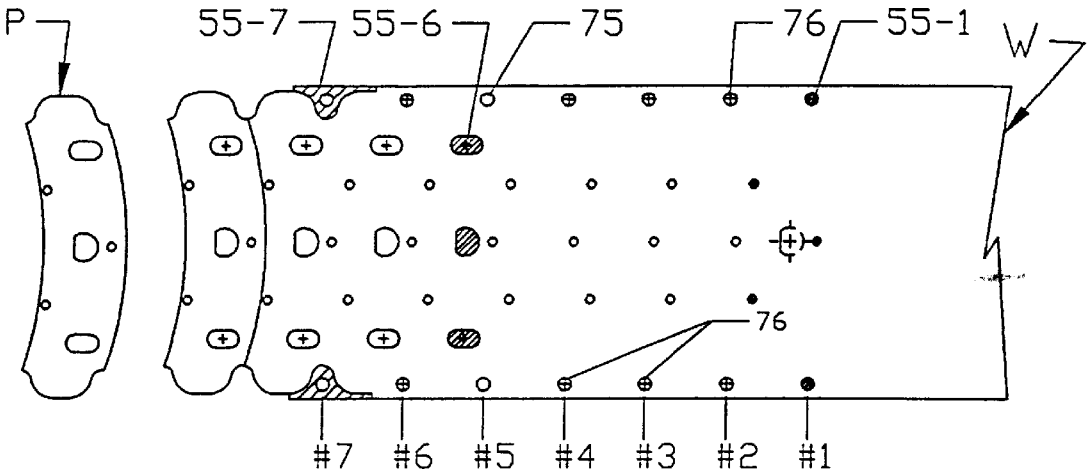
FIG. 10 is a top plane view of web "W", illustrating the effects of sequential stamping stations in making the piece-part "P"
Figure 13:
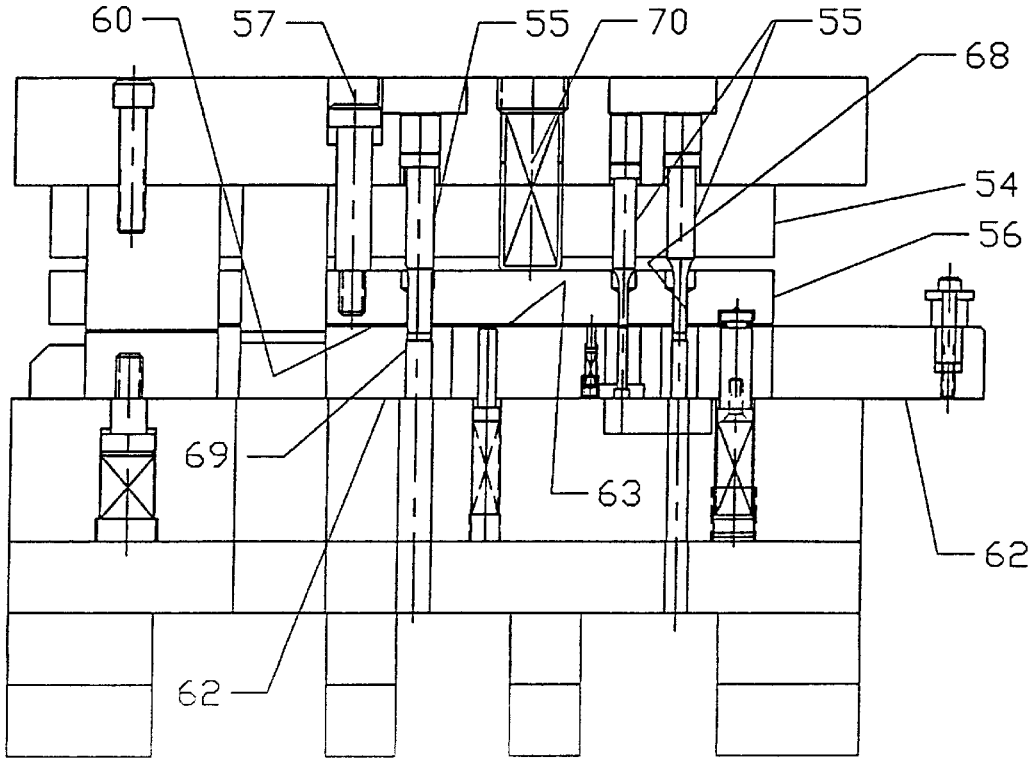
FIG. 13 is random sectional view of the mated base and punch portions of the stamping press "P" of FIGS. 11 and 12.
Figure 11:
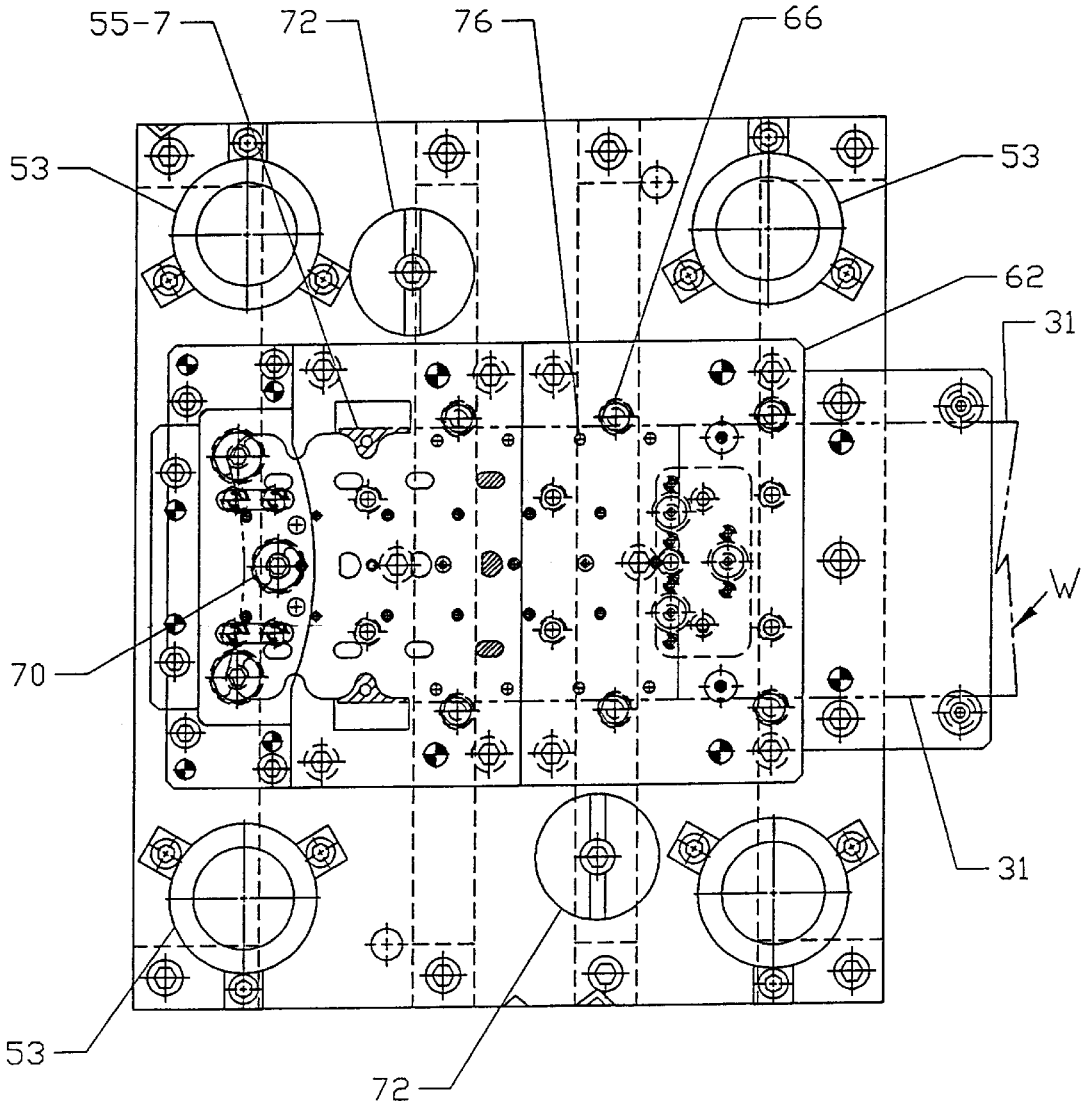
FIG. 11 is a top plan view of the base and die assemblies of the stamping press "P"
Figure 12:
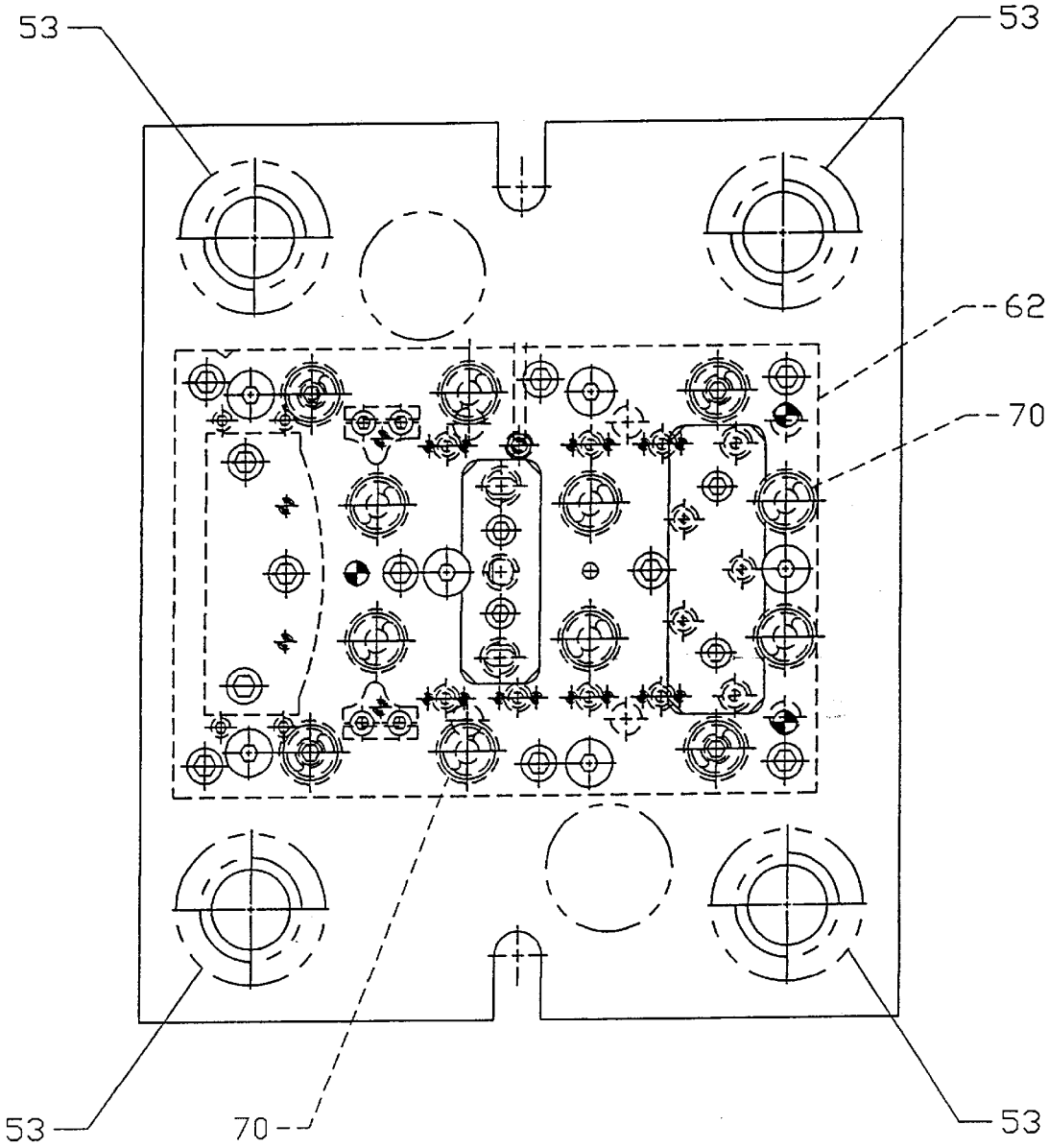
FIG. 12 is a top plan view of the ram and punch portions of the stamping press "P", suited to match up with FIG. 11.

The FIG. 10 plane view of the web "W" shows the effects of sequential stamping strikes at different stations that ultimately produce the illustrated finished piece-part "p". Specifically, the web would be advanced in the press "P" and when positioned at station #1, pilot holes 75 will be pierced in the blank by punches 55-1. When the press opens and punches are separated from the blank, the lifters 66 will elevate the web advanciently to have it advanced on to the station #2, where a pair of pilot pins 76 mounted in the punch holder 54 and extended through an opening in the stripper plate 56 will be spring-biased to project beyond the clamping face 60 and fit into the pilot holes 75 for properly registering the blank with the punch and die components at the striking station; and each striking station thereafter will also have a pair of pilot pins 76, operable to hold the blank in proper registry with the punch and die components of that station. At station #2, coining forms (not shown) mounted in and spring biased upwardly from the die block 62 coin the underside of the blank proximate the pierced holes therein. Stations #3, 4 and 5 are idle stations. At station #6, punches 55-6 pierce holes 78 in the blank; at station #7, punches 55-7 notch off the unwanted edges of the piece; and at station #8, the piece-part "P" is cutoff from the blank and discharged through the underlying opening in the die block 62.

In reality, although all stamping stations will be operating simultaneously, the punches at the different stations might be set at different heights to sequentially strike the blank at the specific stations, so as to reduce the needed power from the stamping press in having the punches pass through or deform the web material simultaneously.

Of advantage, the bowed set of the web "W" will not be eliminated when the web is being flattened during the subsequent stamping procedure, as the stamping press does not flatten the web under extreme pressures, but only imposes such deforming pressures at the specific cooperation regions between the punch and die tool components. Thus, this invention further includes the method of stamping a bowed piece-part in a conventional stamping press with conventional tool components, by pre-bowing the web specifically to a curvature needed that can be held flat overall while being stamped, and yet will emerge as a piece-part with the curvatures needed in the finished piece-part. The pre-bowed web can be advanced through the stamping press, but will only be flexed to a substantially flat configuration during the clamping phase at each stamping station, and without severe compressive forces against the web, so that the web bow will not be undone and the bowed finished piece-part will result.

The angle of curvature limits for pre-bowing the web will exist for any specific web, and will depend on its thickness and overall size and shape, and the resilience, deformation and malleability limits of the material. Of importance, the web must have sufficient resilience to allow it to be pre-bowed to a set curvature in the first place, and then to return to the desired bowed curvature after the stamping procedures when substantially flattened but without critical compression forces, to still meet bowed specifications of the finished piece-part. Of greatest importance to the invention is that all stamping fabrication of individual piece-parts will be when the web or blank is held resiliently by the clamping faces of the stamping press in a generally flattened configuration, so that conventional dies and punch tool components, etc. can be used for economy of tool design and fabrication and for long service live. Further, the needed pre-set bowing of the web can be changed to a smaller or larger radii of curvature, as needed with the easy and generous adjustments possible with the inventive bowing apparatus, to achieve the post-stamping bowed piece-part configuration, without reshaping any of the tool components, which will remain the same. Of further importance, the clamping faces of the stripper plate and die blocks are generally flat, and all movement of the punches is normal to these faces; and fabrication and maintenance of the tooling can be done with conventional equipment and standards, and can be easily controlled, while the tooling wear should remain normal and within accepted limits.

By way of example, piece-parts can be of steel, as a single plate or as several thinner plates bonded together as a laminate, and might be of the order of between possibly 0.01"–0.25" thickness, and a piece-part having a length of perhaps between 4"–6" might have a design specification calling for a center rise of possibly 0.05–0.2", bowed and well out of being a flat sheet. According to this invention, a substantially flat continuous web might be bowed in the bowing apparatus to a sharper or lesser radius of curvature than needed. Again, specific piece-parts can be stamped having a bow or radius of curvature between possibly 30"–5". A piece-part bowed in both the axial and lateral directions can be beneficial in that it exerts enhanced peripheral contact against a flat separate piece, so that overall improved facial bonding between the flat piece and bowed piece-part will be possible due to the extra pressures at the peripheries when the pieces are clamped together.

While a specific embodiment has been illustrated, it will be obvious that minor changes could be made therefrom without departing from the spirit of the invention. Accordingly, the invention is to be determined by the scope of the following claims.

What is claimed:

1. Method of forming finished piece-parts having slight but a variably adjusted three-dimensional bow, from a continuous web, comprising the combination of advancing the web axially of its length, and bowing the web in the same directions of desired bowing in the piece-parts, laterally and/or axially of the web length, operable to impart set bows in the web slightly in excess of the desired finished piece-parts bowing;

passing the bowed continuous web through a conventional stamping press, clamping and substantially flattening therein the bowed web between flat faces of cooperating die block and stripper plate components, and stamping the clamped web between cooperating punch and die assemblies to deform the web to the desired configurations of the finished piece-parts.

2. A method of forming finished bowed piece-parts according to claim 1, further wherein the continuous web is in the form of a laminate of rigid materials comprised of steel, other metals and/or plastics bonded together.

3. A method of forming finished bowed piece-parts according to claim 1, further wherein the web bowing laterally of and/or axially of the web length is done sequentially, and by and between adjustable structures suited to impose adjusted degrees of web set prior to the subsequent stamping and forming of the finished bowed piece-parts.

4. Method of forming finished piece-parts having slight but a variably adjusted three-dimensional bow, from a continuous web originally stored on a reel, comprising the combination of advancing the web axially of its length to remove it from the reel;

passing the web through conventional web straightening apparatus to reshape it to be substantially flat and planar, and then passing the web through a web bowing apparatus for bowing the web in the same directions of desired bowing in the piece-parts, laterally and/or axially of the web length, operable to impart set bows in the web slightly in excess of the desired finished piece-parts bowing; and passing the bowed continuous web through a conventional stamping press, clamping and substantially flattening the bowed web between flat faces of cooperating die block and stripper plate components of the press, and stamping the clamped web between cooperating punch and die assemblies of the press to cut and deform the web to the desired configurations of the finished piece-parts.

5. A method of forming finished bowed piece-parts according to claim 4, further wherein the continuous web is in the form of a laminate of rigid materials comprised of steel and/or other metals and/or plastics bonded together.

6. A method of forming finished bowed piece-parts according to claim 4, further wherein the web bowing laterally of and/or axially of the web length is done sequentially, and by and between adjustable structures of the web bowing apparatus suited to impose adjusted degrees of web set prior to the subsequent stamping and forming of the finished bowed piece-parts.

7. A method of forming finished bowed piece-parts according to claim 4, further wherein the web and thus bowed piece-parts is comprised of dimensionally stable material of a thickness or cross-section less than approximately 0.25".

8. A method of forming finished bowed piece-parts according to claim 6, further wherein the continuous web is in the form of a laminate of rigid materials comprised of steel and/or other metals and/or plastics bonded together, and is of a thickness or cross-section less than approximately 0.25".

* * * * *